US008407813B2

(12) United States Patent
Grilliot et al.

(10) Patent No.: US 8,407,813 B2
(45) Date of Patent: Apr. 2, 2013

(54) PROTECTIVE PANTS, SUCH AS FIREFIGHTER'S PANTS, WITH PUNCTURE-RESISTANT LAYERS AT BELOW-KNEE REGIONS OF LEG PORTIONS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 1234 days.

(21) Appl. No.: 10/695,404

(22) Filed: Oct. 28, 2003

(65) Prior Publication Data

US 2005/0005344 A1 Jan. 13, 2005

Related U.S. Application Data

(63) Continuation-in-part of application No. 10/136,213, filed on May 1, 2002, now abandoned.

(51) Int. Cl.
*A41D 1/06* (2006.01)
*A62B 17/00* (2006.01)

(52) U.S. Cl. ..... 2/227; 2/81

(58) Field of Classification Search ..... 2/227, 228, 2/69, 69.5, 455, 61, 22–24, 81, 904, 231–233, 2/242, 241, 255, 256, 911, 919, 77, 60
See application file for complete search history.

(56) References Cited

U.S. PATENT DOCUMENTS

| | | | | |
|---|---|---|---|---|
| 562,608 | A | 6/1896 | Herbelin | |
| 1,144,150 | A | 6/1915 | Marcovsky | |
| 1,205,680 | A | 11/1916 | Stoneburner | |
| 1,269,930 | A | 6/1918 | Hawley | |
| 1,350,062 | A | 8/1920 | Brewster | |
| 1,527,825 | A * | 2/1925 | Baggerud | 36/2 R |
| 1,691,057 | A | 11/1928 | Greilich | |
| 1,708,144 | A | 4/1929 | Martin | |
| 1,724,413 | A | 8/1929 | Rauh | |
| 1,823,458 | A | 9/1931 | Mayer | |
| 2,127,355 | A * | 8/1938 | Grundstrom | 2/227 |
| 2,544,065 | A * | 3/1951 | Carr | 2/22 |
| 2,720,040 | A | 10/1955 | Rogers | |
| 2,730,723 | A * | 1/1956 | Jonsson | 2/270 |
| 2,819,759 | A | 1/1958 | Goodloe | |
| 3,111,680 | A * | 11/1963 | Horowitz et. al. | 2/227 |
| 3,153,864 | A | 10/1964 | Brewer | |

(Continued)

FOREIGN PATENT DOCUMENTS

| | | | |
|---|---|---|---|
| GB | 2199233 A | * | 7/1988 |
| GB | 2226943 A | * | 7/1990 |

OTHER PUBLICATIONS

Eastbay Catalog; 1999, Catalog No. 2103337909; Source Code: TR9905; Wausau, WI 54402-8066 Backcover of catalog with Eastbay Lined Windpants.*

(Continued)

*Primary Examiner* — Alissa L Hoey
(74) *Attorney, Agent, or Firm* — Wood, Phillips, Katz, Clark & Mortimer

(57) ABSTRACT

A pair of protective pants, such as firefighter's pants or rescue provider's pants, has an upper portion, which when covers a lower region of a wearer's torso, and two leg portions, each of which when worn covers one of the wearer's legs. Each leg portion has an upper region, which extends downwardly from the upper portion, and a lower region, which extends upwardly from a lower end of such leg portion toward the upper region and which terminates not higher than where such leg portion when worn covers the wearer's knee. The pair of protective pants, at the lower region of each leg portion but not elsewhere, has an outer layer of puncture-resistant material.

8 Claims, 1 Drawing Sheet

U.S. PATENT DOCUMENTS

| | | | | | |
|---|---|---|---|---|---|
| 3,191,185 | A | | 6/1965 | Martin | |
| 3,269,036 | A | * | 8/1966 | Parker et al. | 36/2 B |
| 3,284,806 | A | | 11/1966 | Prasser | |
| 3,458,863 | A | | 8/1969 | Lamber et al. | |
| 3,758,963 | A | | 9/1973 | Knight | |
| 3,787,892 | A | | 1/1974 | Quinn | |
| 3,835,470 | A | | 9/1974 | Greiter | |
| 3,924,038 | A | | 12/1975 | McArdie et al. | |
| 3,925,823 | A | | 12/1975 | Kupferman | |
| 4,057,853 | A | | 11/1977 | McLane | |
| 4,079,464 | A | | 3/1978 | Roggin | |
| 4,110,845 | A | * | 9/1978 | Chellis | 36/2 R |
| 4,215,435 | A | * | 8/1980 | Miele | 2/227 |
| 4,282,608 | A | * | 8/1981 | Amberg | 2/227 |
| 4,382,301 | A | | 5/1983 | Hightower, Jr. | |
| 4,461,098 | A | | 7/1984 | Diegelman | |
| 4,483,019 | A | * | 11/1984 | Spangrud et al. | 2/2.16 |
| 4,503,566 | A | | 3/1985 | Wheeler | |
| 4,580,297 | A | | 4/1986 | Maejima | |
| 4,601,066 | A | * | 7/1986 | Campbell | 2/70 |
| 4,622,697 | A | | 11/1986 | Tajima | |
| 4,688,269 | A | | 8/1987 | Maeshima | |
| RE32,506 | E | * | 9/1987 | Hightower, Jr. | 2/22 |
| 4,810,559 | A | | 3/1989 | Fortier et al. | |
| 4,843,654 | A | | 7/1989 | March | |
| 4,896,437 | A | | 1/1990 | Johnson | |
| 4,993,077 | A | * | 2/1991 | Robison | 2/82 |
| 5,001,783 | A | | 3/1991 | Grilliot et al. | |
| 5,010,595 | A | * | 4/1991 | Stradley | 2/227 |
| 5,031,247 | A | | 7/1991 | Carter | |
| 5,033,126 | A | | 7/1991 | Wruck et al. | |
| 5,044,011 | A | | 9/1991 | Henderson | |
| 5,072,454 | A | | 12/1991 | Trahan | |
| 5,095,544 | A | | 3/1992 | Elverskog | |
| 5,131,098 | A | | 7/1992 | Grilliot et al. | |
| 5,170,503 | A | | 12/1992 | Hightower, Jr. et al. | |
| 5,173,967 | A | | 12/1992 | Carter | |
| 5,219,367 | A | | 6/1993 | Fields | |
| 5,471,906 | A | | 12/1995 | Bachner et al. | |
| 5,542,124 | A | | 8/1996 | Grilliot et al. | |
| 5,611,081 | A | | 3/1997 | Torres | |
| 5,634,215 | A | * | 6/1997 | DeBaene | 2/227 |
| 5,649,328 | A | | 7/1997 | Martin | |
| 5,664,256 | A | * | 9/1997 | Blauer et al. | 2/69 |
| 5,729,832 | A | * | 3/1998 | Grilliot et al. | 2/23 |
| 5,864,888 | A | * | 2/1999 | Archer | 2/227 |
| 5,918,319 | A | * | 7/1999 | Baxter | 2/455 |
| 6,041,437 | A | * | 3/2000 | Barker et al. | 2/82 |
| 6,065,151 | A | | 5/2000 | Conine, III | |
| 6,260,196 | B1 | | 7/2001 | van der Sleesem | |
| 6,286,150 | B1 | | 9/2001 | Miller et al. | |
| 6,327,710 | B1 | * | 12/2001 | Dunn et al. | 2/22 |
| 6,338,164 | B1 | | 1/2002 | Howard | |
| 6,353,939 | B1 | * | 3/2002 | Arber | 2/242 |
| 6,385,778 | B1 | * | 5/2002 | Johnson | 2/239 |
| 6,453,791 | B1 | | 9/2002 | Seitiner | |
| 6,487,727 | B1 | * | 12/2002 | Harsant | 2/400 |
| 6,490,733 | B1 | * | 12/2002 | Casaubon | 2/81 |
| 6,559,079 | B1 | | 5/2003 | Bachner, Jr. | |
| D485,049 | S | * | 1/2004 | Newson | D2/742 |
| D528,743 | S | * | 9/2006 | MacMillan | D2/858 |
| 2003/0150042 | A1 | * | 8/2003 | Leflet et al. | 2/23 |
| 2005/0198724 | A1 | * | 9/2005 | Steitle et al. | 2/244 |

OTHER PUBLICATIONS

Eastbay Catalog, 1999, p. 19, item Eastbay Windpants: Eastbay Men's & Women's Lined Windpants.*

Thomaston Mills, Thomaston, Georgia, undated advertising sheet for Rattler's Brand Snake Proof Chaps, admitted prior art.*

* cited by examiner

PROTECTIVE PANTS, SUCH AS FIREFIGHTER'S PANTS, WITH PUNCTURE-RESISTANT LAYERS AT BELOW-KNEE REGIONS OF LEG PORTIONS

CROSS-REFERENCE TO RELATED APPLICATION

This application is a continuation-in-part of U.S. patent application Ser. No. 10/136,213, which was filed May 1, 2002 now abandoned.

TECHNICAL FIELD OF THE INVENTION

This invention pertains to a pair of protective pants, such as firefighter's pants or rescue provider's pants, which is improved by having puncture-resistant layers at below-knee regions of the leg portions of the pants, whereby to provide enhanced, below-knee protection for a wearer, such as a firefighter or a rescue provider, particularly but not exclusively for working at a wildland site, which may have snakes, thorny or spiny plants, or other puncture-threatening hazards.

BACKGROUND OF THE INVENTION

In protective garments, such as firefighter's garments or rescue provider's garments, it is known to provide puncture-resistant patches where the garments cover a wearer's knees and where the garments cover the wearer's elbows. Heretofore, because puncture-resistant materials tend to be quite stiff, puncture-resistant materials have been regarded as unsuitable to cover larger regions of such protective garments.

As exemplified in U.S. Pat. Re. 32,506 and in U.S. Pat. No. 6,065,151, it is known for persons working at wildland sites to wear puncture-resistant chaps over their pants. As exemplified in U.S. Pat. No. 5,170,503, it is known for persons working at wildland sites to wear puncture-resistant leggings over lower leg portions of their pants.

A need has been ascertained, to which this invention is directed, to provide a pair of protective pants, such as firefighter's pants, with enhanced, below-knee protection for a wearer, such as a firefighter, particularly but not exclusively for working at a wildland site, which may have snakes, thorny or spiny plants, or other puncture-threatening hazards, whereby to eliminate a need for the wearer to wear separate chaps or separate leggings.

SUMMARY OF THE INVENTION

This invention provides a pair of protective pants, such as firefighter's pants or rescue worker's pants, which provides improved, below-knee protection for a wearer. The pair of protective pants has an upper portion, which when worn covers a lower region of a wearer's torso, and two leg portions, each of which when worn covers one of the wearer's legs.

Each leg portion has an upper region, which extends downwardly from the upper portion, and a lower region, which extends upwardly from a lower end of said leg portion toward the upper region and which terminates not higher than where said leg portion when worn covers the wearer's knee. The lower region of each leg portion has a layer of puncture-resistant material, which layer is made from a cloth fabric and surrounds the lower region of said leg portion.

Preferably, the upper portion and the upper regions of the leg portions have an outer layer of abrasion-resistant material and the upper portion and the leg portions, from the upper portion to the lower ends of the leg portions, have one or more inner layers. Preferably, moreover, only the lower region of each leg portion has the layer of puncture-resistant material, which surrounds the lower region of said leg portion.

DETAILED DESCRIPTION OF THE ILLUSTRATED EMBODIMENT

Figure 1:
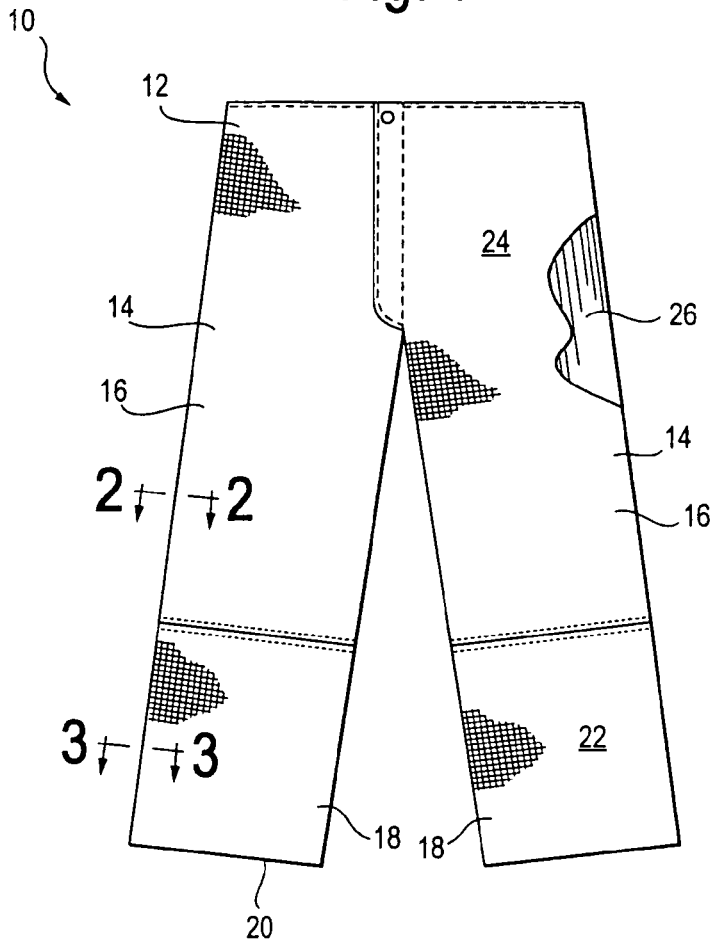
FIG. 1 is a simplified, elevational view of a pair of protective pants, such as firefighter's pants, which embodies this invention.
Figure 2:
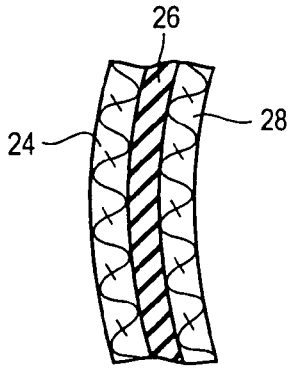
FIG. 2, on a larger scale compared to FIG. 1, is a sectional view, as taken along line 2-2 in FIG. 1, in a direction indicated by arrows.
Figure 3:
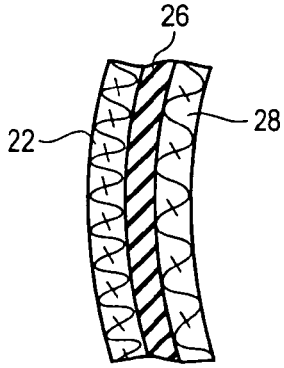
FIG. 3, on a similar scale, is a sectional view, as taken along line 2-3 in FIG. 1, in a direction indicated by arrows.

As shown in the drawings, a pair of protective pants 10, such as firefighter's pants or rescue worker's pants, has an upper portion 12, which when covers a lower region of a wearer's torso, and two leg portions 14, each of which when worn covers one of the wearer's legs. Each leg portion 14 has an upper region 16, which extends downwardly from the upper portion 12, and a lower region 18, which extends upwardly from a lower end 20 of said leg portion 14 to the upper region 16 and which terminates not higher than where said leg portion 14 when worn covers the wearer's knee. As contemplated by this invention, the lower region 18 of each leg portion 14 has an outer layer 22 of puncture-resistant material, which layer 22 is made from a cloth fabric and surrounds the lower region 18 of said leg portion 14.

The upper portion 12 and the upper regions 16 of the leg portions 14 have an outer layer 24 of abrasion-resistant material, which is conventional in firefighter's pants. The upper portion 12 and the leg portions 14, from the upper portion 12 to the lower ends 20 of the leg portions 14, have one or more inner layers, which are conventional in firefighter's pants, such as a moisture-resistant layer 26 and a thermally insulative layer 28. The lower region 18 of each leg portion 14 has the outer layer 22 of puncture-resistant material.

A suitable material for the outer layers 22 of puncture-resistant material is available commercially from HDM, Inc. of St. Paul, Minn., under its SUPER FABRIC trademark. An alternative material for the outer layers 22 of puncture-resistant material is available commercially from Warwick Mills, Inc. of New Ipswich, N.H., under its TURTLESKIN trademark. U.S. Pats. Re. 32,506, No. 5,170,503, and No. 6,065,151 disclose puncture-resistant materials that may be also suitable for the outer layers 22 of puncture-resistant material.

Because only the lower regions 18 of the leg portions 14 have the outer layers 22 of puncture-resistant material, the wearer's movements are not impaired, even if the outer layers 22 of puncture-resistant material are stiff. Nonetheless, the outer layers 22 of puncture-resistant material provide enhanced, below-knee protection for a wearer, such as a firefighter or a rescue provider, particularly but not exclusively for working at a wildland site, which may have snakes, thorny or spiny plants, or other puncture-threatening hazards.

The invention claimed is:

1. A pair of protective pants having an upper portion which when worn covers a wearer's torso, between the wearer's waist and the wearer's legs, the pair of protective pants having two leg portions, each of which when worn covers one of the wearer's legs, wherein each leg portion has an upper region which extends downwardly from the upper portion, and a lower region which extends upwardly from a lower end of said leg portion toward the upper region and which terminates not higher than where said leg portion when worn covers the wearer's knee, wherein the lower region has a puncture-resistant layer made from a cloth fabric that is puncture-resistant, the puncture-resistant layer extends upwardly from the lower end of said leg portion and surrounds the lower end of said leg portion, the cloth fabric being resistant to puncture by snakes or by thorny or spiky plants, wherein the upper region of each leg portion has an outer layer of abrasion-resistant material, the abrasion-resistant material being less resistant to punctures than the puncture-resistant cloth fabric.

2. The pair of protective pants of claim 1 wherein the upper portion also has the outer layer of abrasion-resistant material.

3. The pair of protective pants of claim 1 wherein the upper portion and the leg portions, from the upper portion to the lower ends of the leg portions, have one or more inner layers.

4. The pair of protective pants of claim 1 wherein the upper portion and the upper regions of the leg portions have the outer layer of abrasion-resistant material, wherein the upper portion and the leg portions, from the upper portion to the lower ends of the leg portions, have one or more inner layers, and wherein only the lower region of each leg portion has the puncture-resistant layer.

5. A pair of protective pants having an upper portion which when worn covers a wearer's torso between the wearer's waist and the wearer's legs, the pair of protective pants having two leg portions, each of which when worn covers one of the wearer's legs, each of the leg portions having an upper region which extends downwardly from the upper portion, and a lower region which extends upwardly from a lower end of the leg portion toward the upper region and which terminates not higher than where the leg portion covers the wearer's knee when worn, each of the upper and lower regions having an outer layer of material, and wherein the material of the outer layers of the lower regions has a greater resistance to punctures than the material of the outer layers of the upper regions.

6. The pair of protective pants of claim 5 wherein the upper portion and the upper regions of the leg portions have an outer layer of abrasion-resistant material.

7. The pair of protective pants of claim 5 wherein the upper portion and the leg portions, from the upper portion to the lower ends of the leg portions, have one or more inner layers.

8. The pair of protective pants of claim 5 wherein the upper portion and the upper regions of the leg portions have an outer layer of abrasion-resistant material, and wherein the upper portion and the leg portions, from the upper portion to the lower ends of the leg portions, have one or more inner layers.

* * * * *